United States Patent [19]

Nicolai

[11] Patent Number: 4,517,778

[45] Date of Patent: May 21, 1985

[54] EARTHQUAKE-PROOF BUILDING WITH IMPROVED FOUNDATION

[76] Inventor: Charles M. Nicolai, 401B Pine St., Mill Valley, Calif. 94941

[21] Appl. No.: 437,681

[22] Filed: Oct. 29, 1982

Related U.S. Application Data

[63] Continuation-in-part of Ser. No. 311,671, Oct. 15, 1981, abandoned.

[51] Int. Cl.[3] ..... E04H 9/02

[52] U.S. Cl. ..... 52/167; 308/6 R

[58] Field of Search ..... 52/167; 308/6 R

[56] References Cited

U.S. PATENT DOCUMENTS

| | | | |
|---|---|---|---|
| 1,651,411 | 12/1927 | Porter | 52/167 |
| 2,001,169 | 5/1935 | Wallace | 52/167 |
| 2,035,009 | 3/1936 | Rager | 52/167 |
| 2,055,000 | 9/1936 | Bacigalupo | 52/167 |
| 2,342,302 | 2/1944 | Rubissow | 308/6 R |
| 3,350,821 | 11/1967 | Jones | 52/167 X |
| 3,606,704 | 9/1971 | Denton | 52/167 |
| 4,060,252 | 11/1977 | Mowery | 308/6 R X |
| 4,262,974 | 4/1981 | Tojo et al. | 308/3.8 X |
| 4,402,483 | 9/1983 | Kurabayashi et al. | 52/167 |

FOREIGN PATENT DOCUMENTS

| | | | |
|---|---|---|---|
| 1283759 | 11/1968 | Fed. Rep. of Germany | 52/167 |
| 2328810 | 10/1975 | France | 52/167 |
| 2494330 | 5/1982 | France | 52/167 |
| 2494329 | 5/1982 | France | 52/167 |
| 639666 | 5/1962 | Italy | 52/167 |
| 480804 | 10/1975 | U.S.S.R. | 52/167 |
| 607890 | 5/1978 | U.S.S.R. | 52/167 |
| 699107 | 11/1979 | U.S.S.R. | 52/167 |
| 896190 | 1/1982 | U.S.S.R. | 52/167 |
| 920115 | 4/1982 | U.S.S.R. | 52/167 |

*Primary Examiner*—Alfred C. Perham
*Assistant Examiner*—Jean M. LaKemper
*Attorney, Agent, or Firm*—Phillips, Moore Lempio & Finley

[57] ABSTRACT

An earthquake-proof structure is supported on a foundation comprising a plurality of spaced supports, each including a holder having spherical support members mounted thereon to support the structure. The members are preferably mounted in a cage and guide means are provided for reciprocally mounting the holder to guide vertical movements thereof. In addition, a cushioning system is preferably provided on the holder to resiliently cushion and restrain horizontal movements of the rollers.

18 Claims, 7 Drawing Figures

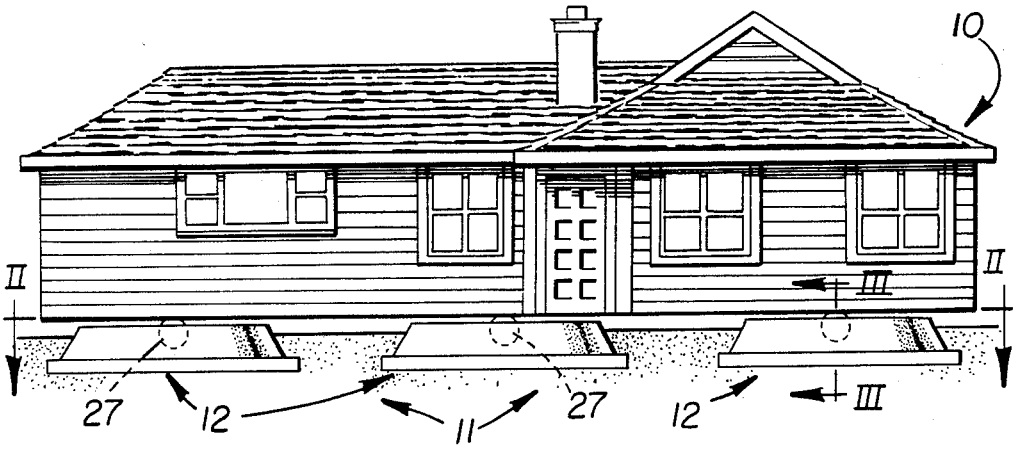
FIGURE 1
FIGURE 2
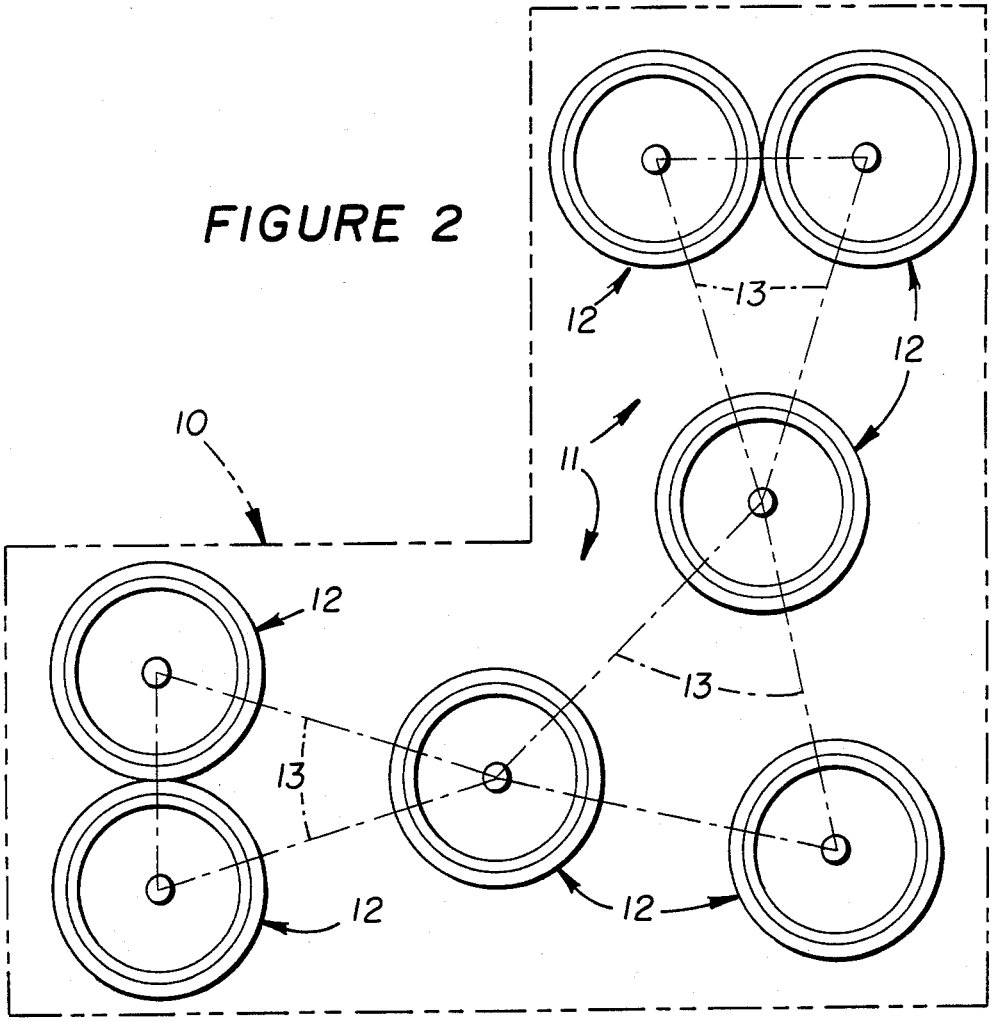

EARTHQUAKE-PROOF BUILDING WITH IMPROVED FOUNDATION

DESCRIPTION

CROSS-REFERENCE TO RELATED APPLICATION

This application is a continuation-in-part of U.S. patent application Ser. No. 311,671 for "Earthquake-Proof Building and Method", filed on Oct. 15, 1981 and now abandoned.

TECHNICAL FIELD

This invention relates generally to an improved earthquake-proof building structure and more particularly to a foundation capable of moving relative to the structure to isolate ground movements resulting from seismic activity.

BACKGROUND ART

As discussed in my co-pending U.S. patent application Ser. No. 311,671, damage to man-made building structures, foundations, and geology, resulting from seismic activity, has been extensively investigated. Such investigations have shown that damage to building structures is primarily induced by the constituent makeup of their foundations. The studies concluded that the natural periods of vibration of the foundation and the supported structure, as well as the nature of the earthquake vibration and the foundation material, must be considered in the design and construction of building structures.

Studies of the above type have given rise to modern-day building techniques, including the driving of piles or support columns into solid ground to support a building structure. However, since the building structure is integrally connected to the foundation and ground, vertical, horizontal, and/or inclined faulting will transmit seismic forces to the building structure directly, regardless of the type of foundation and ground makeup. Other types of foundations have been proposed for building structures in attempts to isolate ground movements, including a "floating" foundation. To date, conventional building techniques of this type have not been widely accepted since they do not provide for the efficient isolation of seismic forces from the building structures and do not further ensure that the building structures will continuously remain in horizontal dispositions when subjected to such forces.

DISCLOSURE OF INVENTION

An object of this invention is to overcome the above, briefly-described problems by providing an improved foundation for isolating movement of the ground from a building structure supported thereon. The foundation comprises a plurality of spaced holders each having roller means mounted thereon to support the structure and for isolating and permitting horizontal movement of the holders relative to the structure when ground surrounding the foundation is subjected to seismic activity.

In one aspect of the improved foundation disclosed and claimed herein, the roller means includes a plurality of spaced rollers and a cage mounting the rollers thereon.

In another aspect of this invention, guide means, secured to the foundation, reciprocally mount each holder thereon to guide vertical movements of the holder.

In still another aspect of this invention, cushioning means, mounted on each holder, at least substantially surrounds the roller means for resiliently cushioning and restraining horizontal movements thereof.

BRIEF DESCRIPTION OF THE DRAWINGS

Other objects and advantages of this invention will become apparent from the following description and accompanying drawings wherein:

FIGS. 1–4 are views illustrating a first foundation embodiment of this invention, fully disclosed in applicant's co-pending U.S. patent application Ser. No. 311,671;

BEST MODE OF CARRYING OUT THE INVENTION

Figure 4:
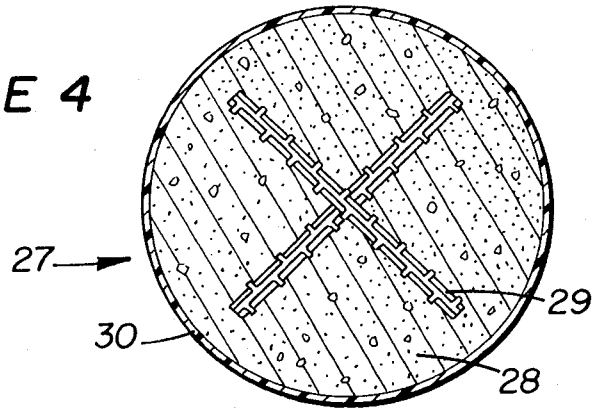
Figure 3:
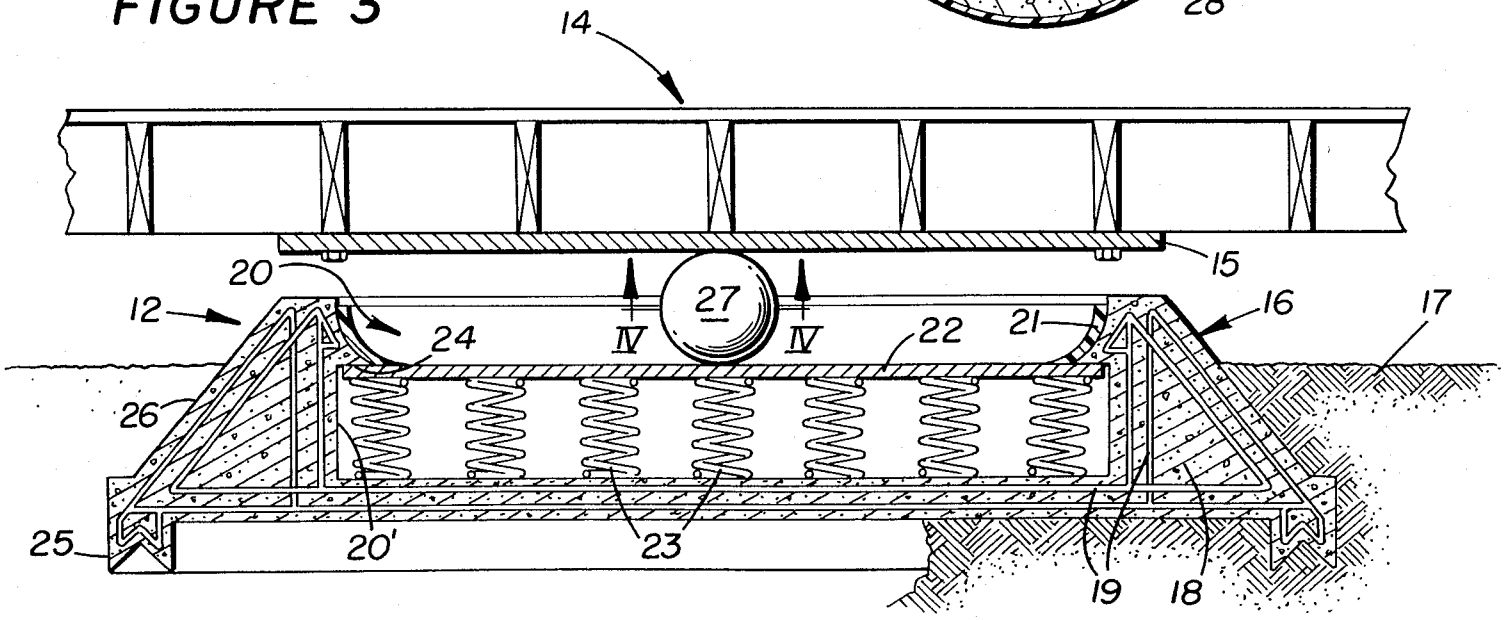

FIGS. 1–4 illustrate a building structure 10 supported on a foundation 11 comprising a plurality of spaced supports 12, the foundation and supports being fully disclosed in applicant's co-pending U.S. patent application Ser. No. 311,671 which is incorporated herein by reference. The supports are preferably disposed in triangular relationships 13 and have a floor structure 14 mounted thereon. A steel bearing plate 15 is secured to the floor and each holder is supported on ground 17.

Each holder defines an annular cavity 20 which may have its peripheral edge coated with a plastic layer 21 with the bottom of the cavity being defined by a steel support plate 22, disposed in a second cavity 20' and supported by a plurality of springs 23. An annular flange 24 engages plate 22 to precompress the springs and limits upward movement of the plate. A lower peripheral edge 25 of the holder is formed with at least one annular wedge that cooperates with a tapered outer surface of the holder to firmly anchor the holder in the ground.

Spherical roller means 27 supports floor structure 14 on the holder and function to isolate and permit horizontal movement of the holder relative to the floor structure when the ground surrounding the foundation is subjected to seismic activity. Each roller means may be composed of concrete 27 (FIG. 4) reinforced by steel rods and a plastic coating 30 may be formed on each roller means.

Figure 5:
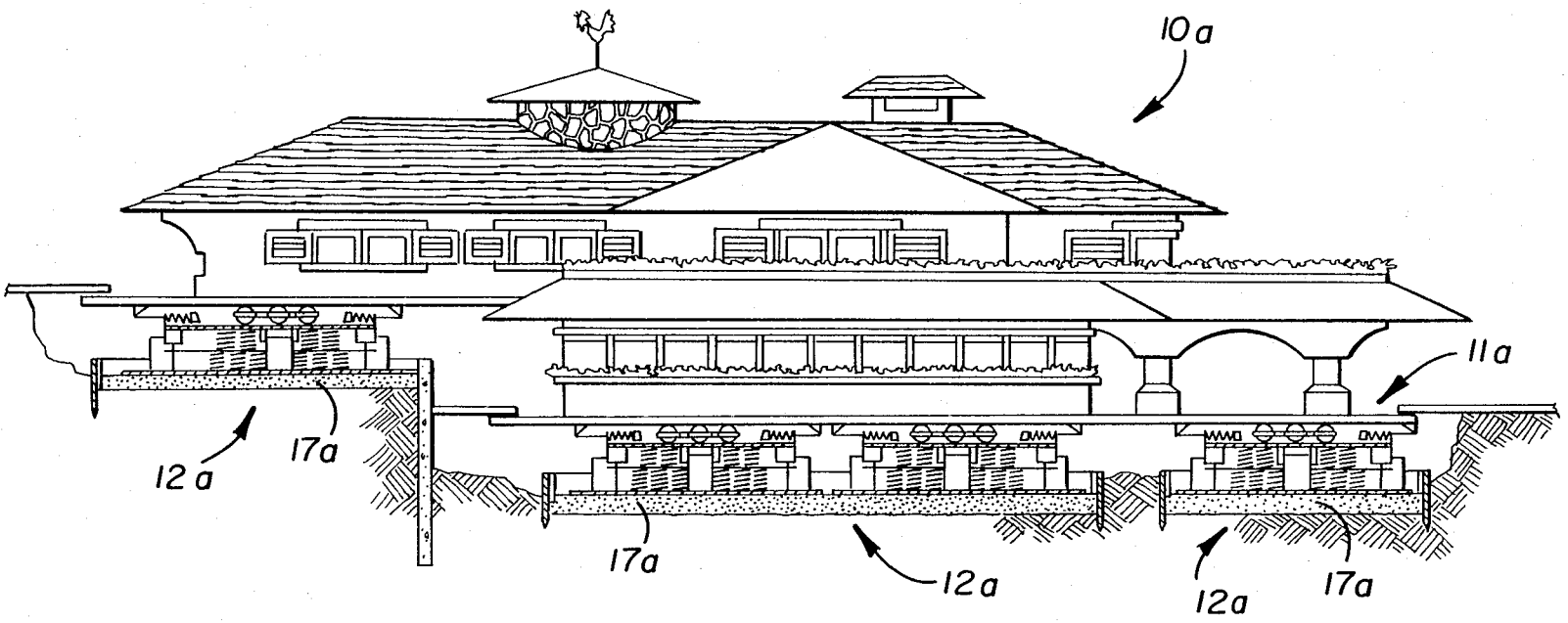
FIG. 5 is a front elevational view of a building structure supported on a second foundation embodiment of this invention, disclosed and claimed herein.
Figure 6:
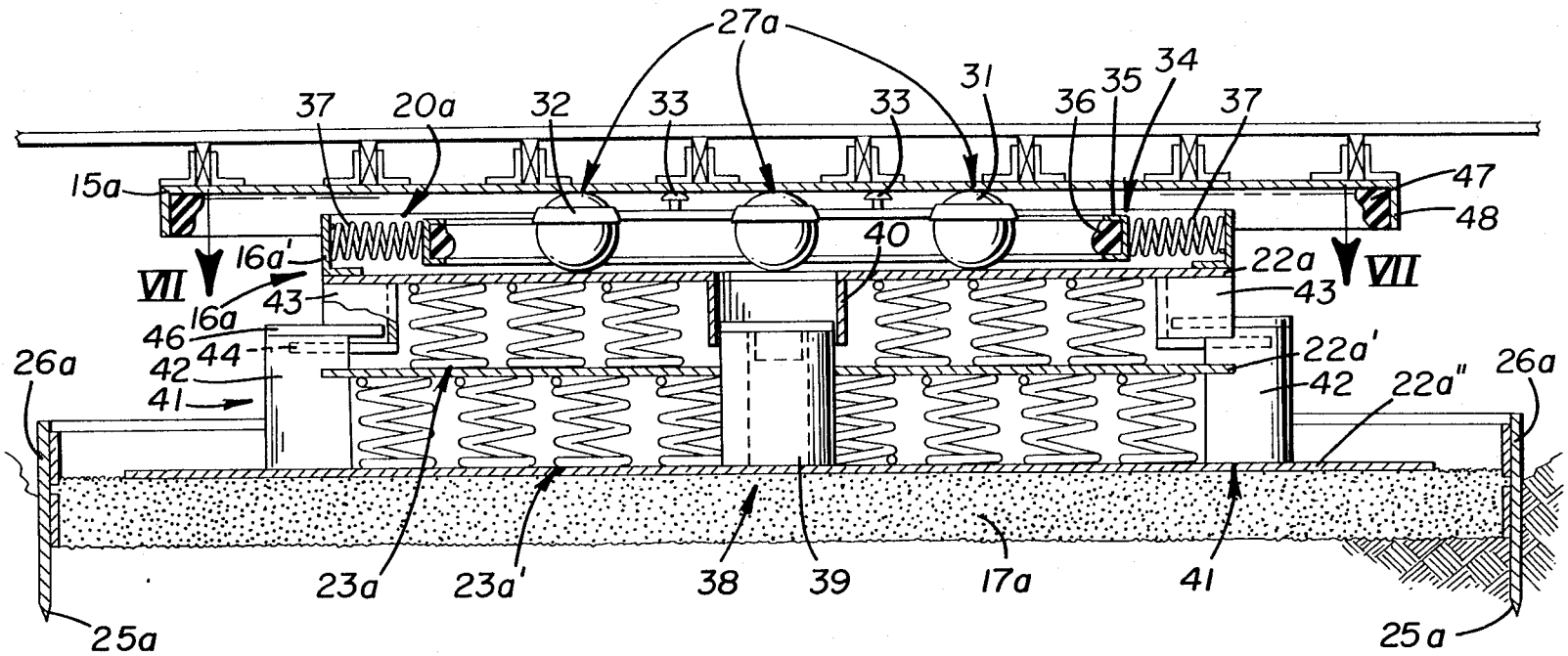
FIG. 6 is a partially sectioned and enlarged front elevational view illustrating one of a plurality of supports employed in the foundation.
Figure 7:
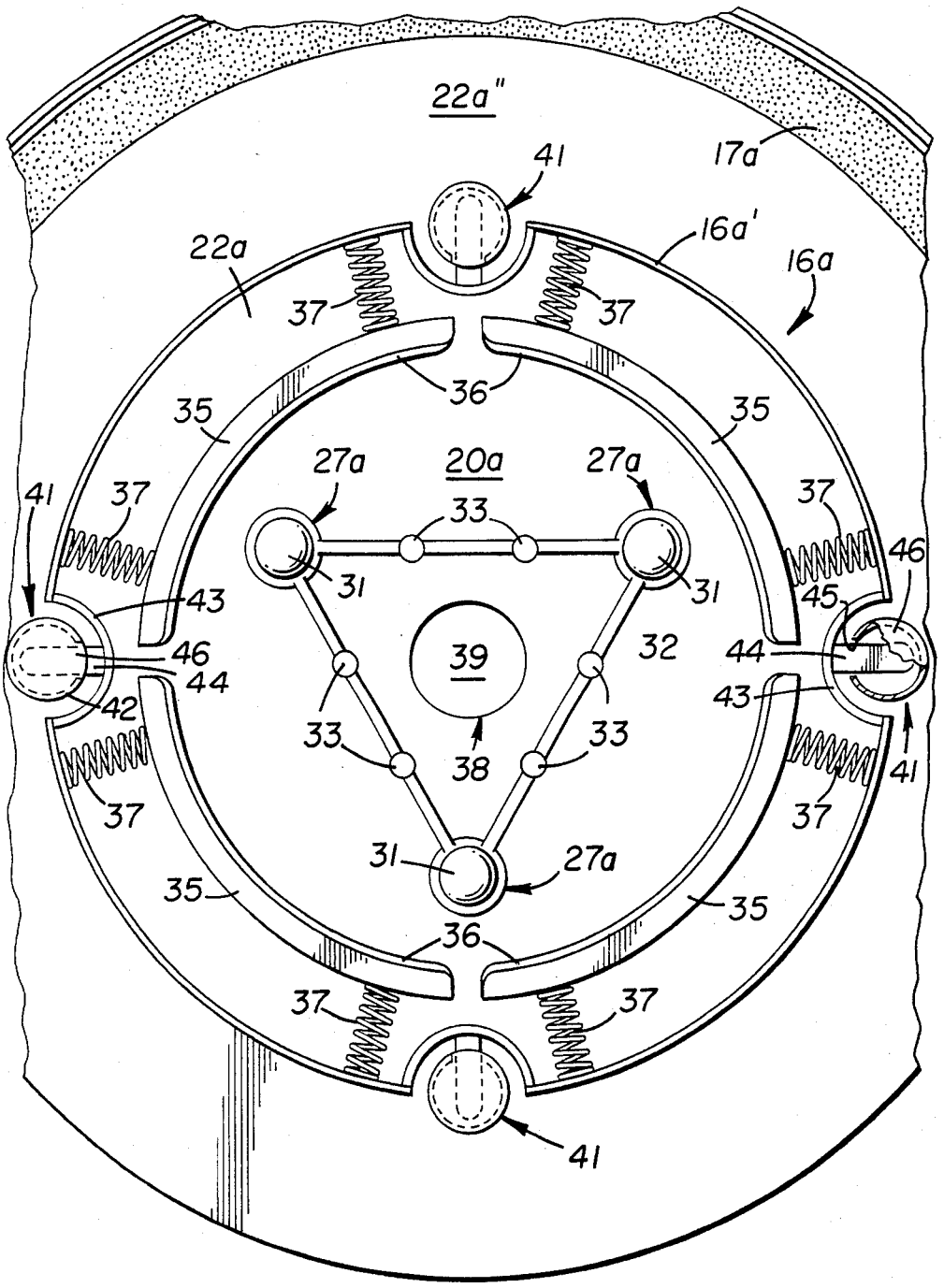
FIG. 7 is a sectional and top plan view of the support, taken in the direction of arrows VII—VII in FIG. 6.

FIGS. 5–7 illustrate an improved and second foundation 11*a*, wherein constructions and arrangements corresponding to those illustrated in FIGS. 1–4 are depicted by identical numerals, but with the corresponding numerals appearing in FIGS. 5–7 being accompanied by an "a".

A building structure 10*a*, also shown in the form of a family residence, is supported on the foundation which comprises a plurality of supports 12*a*. The supports are suitably spaced from each other and are of a sufficient number to fully support the building structure over its entire floor area. The number and spacing of the supports will, of course, depend upon the particular building structure under consideration, i.e., the weight of the building structure should be substantially evenly distributed over the supports.

Referring to FIGS. 6 and 7, building structure 10*a* includes one or more floor structures which may each comprise a reinforced wooden floor or a reinforced concrete slab of standard design. It should be noted that supports 12*a* take the place of a standard foundation, i.e., lower parts of the walls of a conventional building structure and the footing which normally comprises a concrete or cinderblock base on which the foundation rests. A steel bearing plate 15*a* is preferably bolted or otherwise suitably secured to the underside of floor structure 14*a*.

Each support 12*a* comprises an annular holder 16*a* with the holder being preferably mounted on a compacted bed or slab of gravel 17*a*. As shown in FIG. 7, the annular holder may comprise a plurality of circumferentially-disposed and semi-circular steel plates 16*a'*, suitably secured together in a manner hereinafter more fully described. An annular cavity 20*a* is defined in each holder with a steel support plate 22*a* being secured to plates 16*a'* to define a bottom of the cavity.

A resilient support means, shown in the form of a plurality of steel compression coil springs 23*a* and 23*a'*, aid in the absorbtion and isolation of abrupt imposition of the vertical component of seismic forces from the building structure. A first group of circumferentially and radially disposed springs 23*a* are mounted between plate 22*a* and an intermediate plate 22*a'*, whereas a second group of springs 23*a'* are mounted between plate 22*a'* and a lower plate 22*a''*, the latter plate being mounted on gravel bed 17*a*. A lower wedge-shaped edge 25*a* of an annular plate 26*a*, suitably positioned about the periphery of gravel bed 17*a*, positions the gravel and holder on the ground. Alternatively, a plurality of circumferentially-disposed stakes could be substituted in lieu of plate 26*a*.

As further shown in FIGS. 6 and 7, each support 12*a* further comprises roller means 27*a* mounted between plates 15*a* and 22*a* for isolating and permitting horizontal movement of holder 16*a* relative to building structure 10*a* when the ground surrounding slab 17*a* is subjected to seismic activity. Each roller means preferably comprises a steel or cast iron spherical support member or ball, preferably having a diameter in the range of from six inches to two feet. The spaced rollers or balls are mounted in a unitary cage 32 that is preferably triangular and has a ball mounted in each corner thereof, as shown in FIG. 7.

A plurality of adjustable button-type spacers and positioners 33 are preferably threaded or otherwise suitably adjustably mounted on the cage to engage the underside of plate 15*a* to hold the cage downwardly on balls 31. A cushioning means 34 is mounted on holder 16*a* and at least substantially surrounds roller means 27*a* for resiliently cushioning and restraining horizontal movements thereof. As shown in FIGS. 6 and 7, the annular cushioning means preferably comprises a plurality of circumferentially-disposed arcuate ring segments 35 each having an elastomeric pad 36 secured therein to face rollers 31. A plurality of radially-disposed and circumferentially-spaced compression coil springs 37 are mounted between ring 16*a'* and ring segments 35 to cooperate with pads 36 to cushion relative horizontal movements of the rollers.

A center guide means 38 is provided for reciprocally mounting holder 16*a* to guide vertical movements thereof upon relative movements occurring between concrete slab 17*a* and building structure 10*a*. The center guide means may comprise a vertically disposed and cylindrical center post 39 secured on fixed plate 22*a''* and a cylindrical tube 40 secured to the underside of plate 22*a* and mounted in telescopic relationship on the center post. The guide means may further comprise a plurality of circumferentially-spaced outer guide means 41, each having a generally cylindrical post 42 secured in vertically disposed relationship on fixed plate 22*a''*.

Each outer guide means further comprises a semicylindrical shroud 43, secured on an underside of plate 22*a*, and a horizontally-disposed first stop plate 44 secured on a lower end of the shroud to extend radially outwardly through a vertically-disposed slot 45, defined in post 42. As more clearly shown in FIG. 6, a second stop plate 46 is secured on an upper end of post 42 to overlie stop plate 44 to delimit its upward vertical movement. Stop plate 46 further functions to delimit vertical downward movement of retainer 16*a* by its engagement with the underside of plate 22*a*.

From the above description, it can be seen that supports 12*a* provide a substantial advancement in foundation technology, responsive to a growing need for reliable earthquake safety. The overall support system is particularly designed to absorb the shocks and movements generated in the earth during an earthquake. Building structure 10*a* preferably rests on a minimum of three separate supports 12*a* with each support assembly responding individually to variances in ground movement which may result in differing soil and rock formations. Shocks, jolts, and seismic waves generated vertically in the earth are substantially absorbed by spring groups 23*a* and 23*a'*, which are sandwiched between steel plates 22*a*, 22*a'*, and 22*a''*.

This double spring layer ensures superior resilience in the system to prevent jarring impacts therein. Stresses induced by horizontal shaking of the earth are diminished by allowing building structure 10*a* and bearing plate 15*a* on which it is mounted to slide horizontally on roller means 27*a* which are preferably in the form of large steel ball bearings adapted to engage cushioning means 34 for impact absorbing purposes. If so desired, an annular elastomeric pad 47 may be secured within an annular flange 48, secured on the periphery of bearing plate 15*a*, to cushion and delimit horizontal movements of bearing plate 15*a* by its engagement with holder 16*a*.

Each foundation can be manufactured and preassembled to be self-contained. The modular foundation can then be shipped to any remote location for expeditious installation and subsequent construction of building structure 10*a* thereon. The utilization of separate support units renders the overall system readily adaptable to various land formations and architectural plans. The component parts of the foundation, excepting gravel bed or slab 17*a*, are preferably composed of a high-grade steel alloy that is sealed with a suitable anti-rust preservative or paint.

The foundation is flood-proof and fire resistant and is reusable in the event of loss of building structure 10*a* by fire or flood. The overall manufacture and installation cost of the foundation is highly competitive with conventional foundations used for supporting building structures in today's market.

I claim:

1. An earthquake-proof structure supported on a foundation adapted for mounting at ground level, said foundation comprising a plurality of laterally spaced support modules each including a holder disposed in vertically spaced relationship below said structure roller means mounted vertically between said structure and said holder for supporting said structure thereon and for isolating and permitting horizontal and parallel movement of said holder relative to said structure when ground surrounding said foundation is subjected to seismic activity, a first support plate mounted in vertically spaced relationship below said holder, first spring means mounted vertically between said holder and said first support plate for resiliently supporting said holder and for permitting said structure and holder to tilt relative to said first support plate, and second spring means mounted below said first support plate for resiliently supporting said first support plate and for permitting said first support plate to tilt relative to ground level.

2. The invention of claim 1 wherein said roller means comprises three spherical balls disposed in spaced triangular relationship relative to each other and cage means having said balls confined and rotatably mounted therein.

3. The invention of claim 1 further including a plurality of guide means circumferentially spaced about said holder for guiding its vertical movements while permitting said tilting thereof.

4. The invention of claim 3 wherein each said guide means includes a plurality of outer guide means disposed circumferentially about said holder.

5. The invention of claim 4 wherein each said guide means further includes a plurality of inner guide means secured on said holder and disposed circumferentially thereabout and in out-of-contact relationship relative to each respective outer guide means.

6. The invention of claim 4 further comprising stop means for delimiting vertical movement of said holder.

7. The invention of claim 1 wherein said first spring means includes a first group of compression springs mounted between said holder and said first support plate and wherein said second spring means includes a second group of compression springs mounted between said first support plate and a second support plate disposed vertically below said first support plate.

8. The invention of claim 1 further including cage means having said roller means confined and rotatably mounted therein and cushioning means mounted on said holder and at least substantially surrounding said cage means for resiliently cushioning and restraining horizontal movements thereof.

9. The invention of claim 8 wherein said cushioning means includes a circumferentially disposed ring means and spring means mounted between said holder and said ring means for resiliently urging said ring means toward said cage means.

10. A support module adapted for mounting beneath a structure comprising a holder, roller means mounted on said holder for supporting said structure thereon and for isolating and permitting relative horizontal and parallel movement between said holder and said structure when ground surrounding said foundation is subjected to seismic activity, a first support plate mounted in vertically spaced relationship below said holder, first spring means mounted vertically between said holder and said first support plate for resiliently supporting said holder and for permitting said holder to tilt relative to said first support plate, and second spring means mounted vertically below said first support plate for resiliently supporting said first support plate and for permitting said first support plate to tilt.

11. The invention of claim 10 wherein said roller means comprises three spherical balls disposed in spaced triangular relationship relative to each other and cage means having said balls confined and rotatably mounted therein.

12. The invention of claim 10 further including a plurality of guide means circumferentially spaced about said holder for guiding its vertical movements while yet permitting said tilting thereof.

13. The invention of claim 12 wherein each said guide means includes a plurality of outer guide means disposed circumferentially about said holder.

14. The invention of claim 13 wherein each said guide means further includes a plurality of inner guide means secured on said holder and disposed circumferentially thereabout in out-of-contact relationship relative to each respective outer guide means.

15. The invention of claim 14 further comprising stop means for delimiting vertical movement of said holder.

16. The invention of claim 10 wherein said first spring means includes a first group of compression springs mounted between said holder and said first support plate and wherein said second spring means includes a second group of compression springs mounted between said first support plate and a second support plate.

17. The invention of claim 10 further including cage means having said roller means confined and rotatably mounted therein and cushioning means mounted on said holder and at least substantially surrounding said cage means for resiliently cushioning and restraining horizontal movements thereof.

18. The invention of claim 17 wherein said cushioning means includes a circumferentially disposed ring means and spring means mounted between said holder and said ring means for resiliently urging said ring means toward said cage means.

* * * * *